United States Patent [19]

Watanabe

[11] 3,976,480

[45] Aug. 24, 1976

[54] NICKEL BASE ALLOY

[75] Inventor: Rikizo Watanabe, Yasugi, Japan

[73] Assignee: Hitachi Metals, Ltd., Tokyo, Japan

[22] Filed: Sept. 18, 1974

[21] Appl. No.: 507,237

[52] U.S. Cl. ..... 75/171; 148/32.5

[51] Int. Cl.[2] ..... C22C 19/05

[58] Field of Search ..... 75/171, 170; 148/32, 148/32.5

[56] References Cited

UNITED STATES PATENTS

| | | | |
|---|---|---|---|
| 2,951,757 | 9/1960 | Brown | 75/171 |
| 3,385,698 | 5/1968 | MacFarlane et al. | 75/171 |
| 3,615,376 | 10/1971 | Ross | 75/171 |

*Primary Examiner*—R. Dean

*Attorney, Agent, or Firm*—Stewart and Kolasch, Ltd.

[57] ABSTRACT

A nickel base alloy containing, in weight percent, from 0.05 to 0.25% carbon, from 15 to 17.5% chrominum, from 5 to 15% cobalt, no more than 6% molybdenum, from 3 to 13% tungsten, from 1.5 to 3% aluminum, from 3.5 to 4.5% titanium, no more than 0.05% boron, no more than 0.5% ziroconium, balance essentially nickel, except for impurities, wherein:

the sum of molybdenum and 1/2 tungsten is 5.5 to 7.5%;

the sum of aluminum and titanium is 5.0 to 7.5;

in case the amount of tungsten is from 7 to 13%, that of aluminum is 1.5 to 2.5%; and in case the amount of tungsten is 3 to 7%, that of aluminum is 2 to 3%.

This alloy presents a superb combination of high strength at an elevated temperature and high resistance to sulfurization.

5 Claims, 1 Drawing Figure

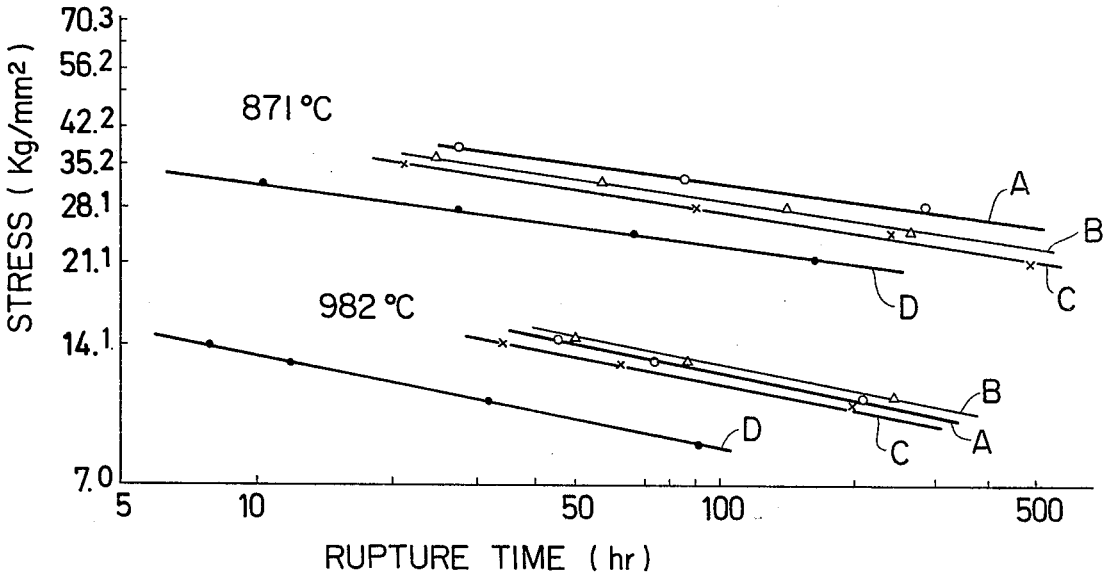
70.3
56.2
42.2
35.2
28.1
21.1
14.1
7.0
STRESS ( Kg/mm² )
871 °C
982 °C
A
B
C
D
5
10
50
100
500
RUPTURE TIME ( hr )

NICKEL BASE ALLOY

BACKGROUND OF THE INVENTION

1. Field of the Invention

This invention relates to a nickel base alloy for use as a turbine blade of a gas turbine.

2. Description of the Prior Art

Turbine blades of a gas turbine should provide extremely high strength at elevated temperature for withstanding the centrifugal force created due to the rotation of the turbine blade at an elevated temperature. In addition, turbine blades should afford high resistance to sulfurization at elevated temperature due to sulfur contained in the fuel. However, since strength at elevated temperatures and sulfurization resistance are imcompatible to each other, the prior art alloys of this kind seldom provide a combination of these two properties.

It is accordingly a principal object of the present invention to provide a nickel base alloy having a superb combination of high strength at elevated temperature and high resistance to sulfurization.

These and other objects and advantages of the present invention will become apparent to those skilled in the art from a consideration of the following specification and claims in conjunction with the appended drawings.

BRIEF DESCRIPTION OF THE DRAWINGS

The drawing shows the results of creep tests given to alloys according to the present invention and prior art alloys of this kind.

SUMMARY OF THE INVENTION

According to the present invention, there is provided a nickel base alloy containing, in weight percent, from 0.05 to 0.25% carbon, from 15 to 17.5% chrominum, from 5 to 15% cobalt, no more than 6% molybdenum, from 3 to 13% tungsten, from 1.5 to 3% aluminum, from 3.5 to 4.5% titanium, no more than 0.05% boron, no more than 0.5% zirconium, balance essentially nickel, except for impurities, wherein: the sum of molybdenum and 1/2 tungsten is 5.5 to 7.5%; the sum of aluminum and titanium is 5.0 to 7.5%; in case the amount of tungsten is from 7 to 13%, the amount of aluminum is 1.5 to 2.5%, and in case the amount of tungsten is 3 to 7%, that of aluminum is 2 to 3%.

The nickel base alloy according to the present invention preferably contains in weight percent from 0.1 to 0.2% carbon, from 15 to 17.5% chrominum, from 8 to 12% cobalt, from 1.5 to 5.5% molybdenum, from 3 to 11% tungsten, from 1.7 to 2.8% aluminum, from 3.7 to 4.3% titanium, no more than 0.03% boron, no more than 0.2% zirconium, balance essentially nickel, except for impurities, wherein: the sum of molybdenum and ½ tungsten is 5.5 to 7.5%; the sum of aluminum and titanium is 5.5 to 7.0%; in case the amount of tungsten is from 7 to 11%, that of aluminum is from 1.7 to 2.3%; and in case the amount of tungsten is from 3 to 7%, that of aluminum is 2.2 to 2.8%.

More preferably, the nickel base alloy according to the present invention contains, in weight percent, about 0.15% carbon, about 16% chrominum, about 10% cobalt, about 2% molybdenum, about 10% tungsten, about 2% aluminum, about 4% titanium, about 0.015% boron, about 0.05% zirconium, balance essentially nickel, except for impurities, and about 0.15% carbon, about 16% chromium, about 10% cobalt, about 3% molybdenum, about 6% tungsten, about 2.5% aluminum, about 4% titanium, about 0.015% boron, about 0.05% zirconium, balance essentally nickel, except for impurities.

DETAILED DESCRIPTION OF THE INVENTION

The nickel base alloy according to the present invention contains, in weight percent, from 0.05 to 0.25% carbon, from 15 to 17.5% chrominum, from 5 to 15% cobalt, no more than 6% molybdenum, from 3 to 13% tungsten, from 1.5 to 3% aluminum, from 3.5 to 4.5% titanium, no more than 0.05% boron, no more than 0.5% zirconium, balance essentially nickel, except for impurities, wherein:

the sum of molybdenum and ½ tungsten is 5.5 to 7.5;

the sum of aluminum and titanium is 5.0 to 7.5;

in case the amount of tungsten is from 7 to 13%, that of aluminum is 1.5 to 2.5%; and in case the amount of tungsten is 3 to 7%, that of aluminum is 2 to 3%, thereby presenting a superb combination of high strength at an elevated temperature and high resistance to sulfurization.

According to the alloy of the present invention, part of carbon combines with titanium to form a stable TiC, and the other part of carbon is precipitated along grain boundaries in the form of $M_{23}C_6$ or $M_6C$ type carbide, thereby strengthening the grain boundaries of the alloy. Carbon content of no more than 0.05% fails to present the aforesaid effects, while carbon content of over 0.25% results in an excessive increase in amount of TiC, thus impairing the ductility of an alloy, with the accompanying decrease in amount of titanium which is effective in precipitation hardening. Carbon should be present within the range of 0.05 to 0.25%. Preferably, carbon amount should fall in the range of 0.1 to 0.2%.

Chrominum is essential in affording resistance to sulfurization. According to the alloy of the present invention, a minimum of 15% chrominum is required for affording desired resistance to sulfurization. Chrominum level exceeding 17.5% causes instable crystal structures and enhances the formation of detrimental intermetallic compounds such as $\gamma$ phase. Thus, chrominum content should be within the range of 15 to 17.5%.

Cobalt dissolves as solid solution in the matrix and improves the strength of alloy at an elevated temperature as well as ductility at an elevated temperature. A minimum of 5% cobalt should be present. A cobalt content of over 15% causes the structure of an alloy instable, enhancing the precipitation of detrimental intermetallic compounds. Cobalt should be present within the range between 5 and 15%. However, the cobalt content should preferably be 8 to 12%.

Molybdenum and tungsten are dissolved in the matrix as solid solution, thereby strengthening the matrix, while part of molybdenum and tungsten are dissolved in $\gamma$ prime phase as solid solution. The amount of tungsten dissolved in the $\gamma$ prime phase as solid solution is greater than that of molybdenum. According to the alloy of the present invention, for obtaining sufficient strength for alloy by dissolving molybdenum and tungsten in the matrix as solid solution, the sum of molybdenum and ½ tungsten should be at least 5.5% in amounts. However, if the aforesaid sum exceeds 7.5%, then the structure of the matrix is rendered instable. It follows that the sum of molybdenum and ½ tungsten should desireably be within the range from 5.5 to 7.5%.

In addition, according to the alloy of the invention, the molybdenum content of over 6% renders the structure of an alloy instable. Thus, the molybdenum content should be no more than 6%. Molybdenum should preferably be present in amounts within the range from 1.5 to 5.5%. In addition, tungsten should be present at least 3% for strengthening the alloy due to the formation of solid solution. The tungsten level of over 13% results in instable structure of an alloy. Thus, the amount of tungsten is limited to a range from 3 to 11%.

Aluminum and titanium produce $Ni_3(Al, Ti)$, that is a $\gamma$ prime phase and strengthen the alloy due to precipitation. According to the alloy of the invention, if the sum of the contents of aluminum and titanium falls short of 5%, then those elements fail to afford desired strength to the alloy. On the other hand, if the aforesaid sum exceeds 7.5%, then there results instable structure of the alloy. For this reason, the sum of aluminum and titanium is limited to the range covering between 5 and 7.5%. Aluminum is essential for providing stable $\gamma$ prime phase. According to the alloy of the invention, a minimum of 1.5% aluminum is required, while the aluminum level of over 3% reduces the lattice constant of the $\gamma$ prime phase and lowers the coherency to a matrix. Thus, aluminum level should fall in the range of 1.5 to 3%. A minimum of 3.5% titanium is essential for affording sufficient strength to the alloy at an elevated temperature. If the amount of titanium is in excess of 4.5%, then titanium renders the $\gamma$ prime phase instable. For this reason, the amount of titanium should be within the range of 3.5 to 4.5%. Preferable range in amounts of aluminum and titanium are from 1.7 to 2.8%, from 3.7 to 4.3%, respectively.

Tungsten is unique in substituting aluminum in $\gamma$ prime phase. Accordingly, in the range of tungsten content of 3 to 13%, when the tungsten amount is 7 to 13% which is the higher half of the range, the amount of aluminum should fall in a lower half of the range, i.e., from 1.5 to 2.5% within the range of 1.5 to 3%. On the other hand, in case tungsten amount is in the range of 3 to 7% which is a lower half of the range, the amount of aluminum should be within the range between 2 and 3%. For the same reason, it is preferable that, in case the tungsten level is in the preferable range of 3 to 11%, the amount of aluminum is within the range of 1.7 to 2.3%, when for instance the amount of tungsten is from 7 to 11%. On the other hand, the amount of aluminum should be in the range from 2.2 to 2.8%, if for instance the tungsten level is from 3 to 7%.

Preferred combinations of molybdenum, tungsten, aluminum and titanium are given in the following table I:

Table I

| Combination designation | Mo | W | Al | Ti |
|---|---|---|---|---|
| 1 | 2 | 10 | 2 | 4 |
| 2 | 3 | 6 | 2.5 | 4 |
| 3 | 3 | 8 | 2 | 4 |

Table I-continued

| Combination designation | Mo | W | Al | Ti |
|---|---|---|---|---|
| 4 | 5 | 4 | 2.5 | 4 |

unit: wt %

Boron and zirconium are apt to be segregated along grain boundaries in a nickel base alloy to thereby strengthen the grain boundaries, contributing to the improvements in the strength at an elevated temperature as well as in the ductility at an elevated temperature. Thus, a suitable amount of boron and zirconium should advantageously be present. However, the excessive amounts of boron and zirconium give rise to the formation of intermetallic compounds having a low melting point to thereby lower the forgeability of the alloy. Accordingly, the boron content should be no more than 0.05%, while the zirconium content should be no more than 0.5%.

DESCRIPTION OF THE PREFERRED EMBODIMENTS

The following example is given merely as illustrative of the present invention and is not to be considered as limiting. Unless otherwise stated, the percentages therein and throughout the application are by weight.

EXAMPLE

For comparison of alloys according to the present invention with conventional similar alloys in terms of the strength at an elevated temperature and resisting characteristic to sulfurization, samples of alloys having compositions as shown in Table 2 were prepared according to vacuum melting and vacuum casting.

Table 2

| | Chemical Composition (wt %) | | | | | | | | | | |
|---|---|---|---|---|---|---|---|---|---|---|---|
| Alloy | C | Cr | Co | Mo | W | Al | Ti | Nb | B | Zr | Ni |
| A | 0.10 | 15.4 | 10.0 | 2.1 | 9.9 | 2.0 | 3.9 | — | 0.015 | 0.06 | Balance |
| B | 0.14 | 15.5 | 10.2 | 3.1 | 5.9 | 2.6 | 4.1 | — | 0.017 | 0.06 | " |
| C | 0.06 | 17.8 | 15.0 | 3.1 | 1.7 | 2.3 | 5.0 | — | 0.015 | — | " |
| D | 0.06 | 17.7 | 18.2 | 4.2 | — | 2.9 | 3.1 | — | 0.007 | 0.06 | " |
| E | 0.12 | 15.2 | 9.0 | 2.1 | 3.6 | 4.1 | 1.8 | 2.2 | 0.015 | 0.06 | " |
| F | 0.13 | 12.4 | — | 4.9 | — | 5.8 | 0.8 | 2.1 | 0.010 | 9.11 | " |

A and B represent alloys according to the present invention, while D, E and F designate conventional alloys as used in the practical application.

Alloy samples A, B, C and D were held at a temperature of 1150°C for two hours, then air cooled, held at a temperature of 1080°C for four hours, then air cooled, held at a temperature of 760°C for 16 hours, and air cooled, while alloy sample E was held at a temperature of 1180°C for two hours, then air cooled, held at a temperature of 1080°C for four hours, then air cooled, held at a temperature of 870°C for 16 hours and air cooled. Alloy sample F was tested in as cast state.

The appended drawing illustrates the results of creep tests given to alloy samples A, B, C and D at temperatures of 871°C and 982°C. The creep rupture time is represented as an abscissa, while the stress is represented as an ordinate. It can be seen from this that the alloy samples A and B according to the present invention present excellent rupture strength, as contrast to those of the conventional alloy samples C and D.

For comparison in the resistance to sulfurization of alloys, respective samples of the dimensions of a diameter of 10 mm and a length of 10 mm were dipped in ash consisting of 75% $Na_2SO_4$ and 25% NaCl, heated to 900°C for 20 hours, after which reductions in weight of respective samples were determined as the ratio, in percentage, of the weight before tests to those after tests. Table 3 below shows the aforesaid ratios:

Table 3

| Alloy | A | B | C | D | E | F |
|---|---|---|---|---|---|---|
| Reduction % | 0.2 | 0 | 0.2 | 0.1 | 41.0 | 76.8 |

As can be seen from the above table 3, alloy samples A and B according to the present invention present excellent resistance to sulfurization, as compared with conventional alloys. In addition, alloys according to the present invention are well comparable in resistance to sulfurization with the conventional alloys C and D which are known as being excellent in the resistance to sulfurization.

As is apparent from the foregoing description, the present invention presents a nickel base having a superb combination of excellent strength at an elevated temperature and resistance to sulfurization. The alloys according to the invention may be applied to foreging, and thus find its use as a turbine blade of a gas turbine as well as in many fields of industries which demand alloys of high strength at an elevated temperature and high resistance to sulfurization.

What is claimed is:

1. A forgeable nickel base alloy consisting essentially of, in weight percent, from 0.1 to 0.2% carbon, from 15 to 17.5% chromium, from 8 to 12% cobalt, from 1.5 to 5.5% molybdenum, from 7 to 13% tungsten, from 1.5 to 2.5% aluminum, from 3.7 to 4.3% titanium, no more than 0.3% boron, no more than 0.2% zirconium, the balance being essentially nickel, except for impurities, wherein: the sum of molybdenum and ½ tungsten is 5.5 to 7.5%; the sum of aluminum and titanium is 5.5 to 7.0%; and in case the amount of tungsten is from 7 to 11%, the amount of aluminum is from 1.7 to 2.3%.

2. A forgeable nickel base alloy consisting essentially of, in weight percent, about 0.15% carbon, about 16% chromium, about 10% cobalt, about 2% molybdenum, about 10% tungsten, about 2% aluminum, about 4% titanium, about 0.015% boron, about 0.05% zirconium, the balance being essentially nickel, except for impurities.

3. A forgeable nickel base alloy consisting essentially of, in weight percent, about 0.15% carbon, about 16% chromium, about 10% cobalt, about 3% molybdenum, about 6% tungsten, about 2.5% aluminum, about 4% titanium, about 0.015% boron, about 0.05% zirconium, the balance being essentially nickel, except for impurities.

4. A forgeable nickel base alloy consisting essentially of, in weight percent, from 0.1 to 0.2% carbon, from 15 to 17.5% chromium, from 8 to 12% cobalt, from 1.5 to 5.5% molybdenum, from 7 to 11% tungsten, from 1.7 to 2.3% aluminum, from 3.7 to 4.3% titanium, no more than 0.05% boron, no more than 0.5% zirconium, and the balance being essentially nickel, except for impurities.

5. The forgeable nickel base alloy of claim 4, wherein the sum of molybdenum and ½ tungsten is 5.5 to 7.5% and the sum of aluminum and titanium is 5.5 to 7.0%.

* * * * *